US006079399A

United States Patent [19]

DeYonker

[11] Patent Number: 6,079,399

[45] Date of Patent: Jun. 27, 2000

[54] ARCHERY BOX ACCESSORY

[76] Inventor: Marc J. DeYonker, 22491 Alexander, St. Clair Shores, Mich. 48081

[21] Appl. No.: 09/394,811

[22] Filed: Sep. 13, 1999

[51] Int. Cl.[7] ..... F41B 5/22

[52] U.S. Cl. ..... 124/24.1; 124/44.5

[58] Field of Search ..... 124/23.1, 24.1, 124/44.5, 86

[56] References Cited

U.S. PATENT DOCUMENTS

| | | | |
|---|---|---|---|
| 4,027,645 | 6/1977 | Damron | 124/24.1 |
| 4,041,925 | 8/1977 | Barrick | 124/35.2 |
| 4,446,844 | 5/1984 | Nishioka | 124/44.5 |
| 4,829,974 | 5/1989 | Anderson | 124/24.1 |
| 5,263,465 | 11/1993 | Anderson | 124/24.1 |
| 5,520,163 | 5/1996 | Hurd | 124/24.1 |
| 5,553,597 | 9/1996 | Sparks | 124/44.5 |

*Primary Examiner*—John A. Ricci
*Attorney, Agent, or Firm*—Charles W. Chandler

[57] ABSTRACT

An archery bow can be equipped with an arrow guidance-support accessory without requiring any modification of the bow. The accessory includes a pair of linear guide blocks located above the bow arrow rest, a pair of spaced parallel elongated cylindrical arrow supports slidably adjustable in the guide blocks, and a bridge connecting the arrow supports behind the bowstring. Two resilient arrow retention wands extend forwardly from the bridge for frictionally engaging upper side surfaces of the arrow resting on the arrow supports.

14 Claims, 3 Drawing Sheets

ARCHERY BOX ACCESSORY

BACKGROUND AND SUMMARY OF THE INVENTION

This invention relates to an archery bow accessory, and particularly to an accessory for supporting and guiding an arrow during the arrow-launching process.

Some arrow guidance mechanisms have been used on archery bows. U.S. Pat. No. 4,041,925, issued to Robert R. Barrick, shows an arrow launch assembly that includes a hand grip connected to an elongated tubular element that is slidably supported in an arrow rest member. The arrow is supported at two spaced points, near the handgrip and on the arrow rest member. Due to the construction of the rest member, the arrow has no lateral guidance.

U.S. Pat. No. 4,027,645, issued to William M. Damron, shows an arrow support structure, wherein the arrow is located within a hollow tubular guide tube. The tube is slotted to permit passage of the bowstring during the arrow launch process.

U.S. Pat. No. 4,829,974, issued to Jeffrey R. Anderson, shows an arrow support mechanism that includes an arrow launch tube guided for linear motion by means of support rollers carried by the riser portion of the archery bow. The launch tube is designed for use with relatively short, non-standard, arrows.

Many of the prior art devices used for support and/or guidance of an arrow during the arrow launch process require special archery bow constructions or bow modifications. The present invention relates to an accessory for supporting and guiding a conventional arrow during the arrow-launch process, wherein the accessory can be mounted on a standard archery bow, without modification or reconstruction of the bow.

In one preferred embodiment of the invention, the accessory includes a linear guide mechanism mountable on a conventional archery bow in the space above the conventional arrow rest. Two parallel cylindrical arrow support members are slidable in the linear guide mechanism for retracting motion in response to a manual pull on the bowstring. The rear ends of the cylindrical arrow support members connect with a bridge that is adapted to span the space behind the bowstring, to provide the force for moving the cylindrical arrow support members.

The arrow is retained on the arrow support members by means of two resilient wands that extend forwardly from the bridge for exerting a light frictional grip on the arrow at points spaced forwardly from the bridge.

The above-mentioned wands and arrow support members are circumferentially arranged around the arrow shaft axis so that the arrow is contacted at four circumferentially spaced points or zones. The arrow is prevented from lateral dislocations, such that during the arrow launch process the arrow travels accurately along the intended flight path. The resilient wands exert minimal frictional forces on the arrow surface, so as not to impede the arrow launch velocity.

A significant advantage of the resilient wands is that they frictionally retain the arrow in the launch position on the archery bow, even though the archer might manipulate the bow into various positions in which the arrow might otherwise disengage from the bow (or bowstring). The archer can walk, climb, sit or move the archery bow without dislodging the arrow from the launch position. When a target is sighted, the archer can raise the bow into a firing position without having to fit an arrow to the bowstring.

Specific features of the invention will be apparent from the attached drawings and description of an illustrative embodiment of the invention.

DESCRIPTION OF A PREFERRED EMBODIMENT OF THE INVENTION

Figure 1:
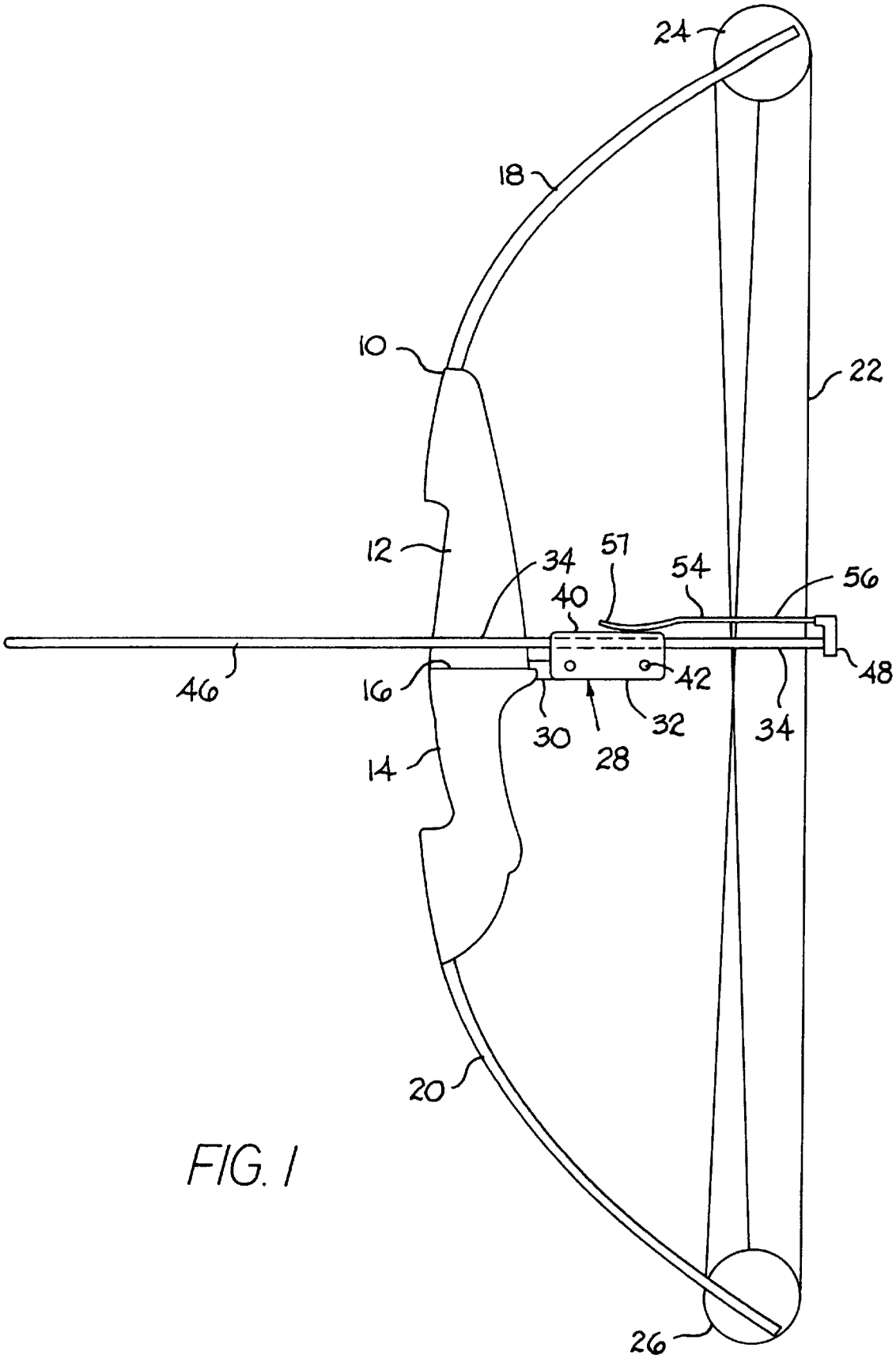
FIG. 1 is a side elevational view of an archery bow equipped with an arrow-support accessory constructed according to the invention.

Referring to FIG. 1, a conventional compound archery bow 10 includes a handle riser 12, handle 14, arrow rest 16, upper limb 18, and lower limb 20. A bowstring 22 is trained between a top wheel 24 and a bottom wheel 26.

The invention relates more particularly to an arrow support accessory 28 mountable on the riser portion 12 of the archery bow. Accessory 28 includes a mounting bar 30, linear guide mechanism 32 supported by bar 30, and an arrow support means 34 slidable in the linear guide mechanism. The arrow is not shown in FIG. 1, but is fragmentarily shown in FIGS. 5 and 6.

Figure 2:
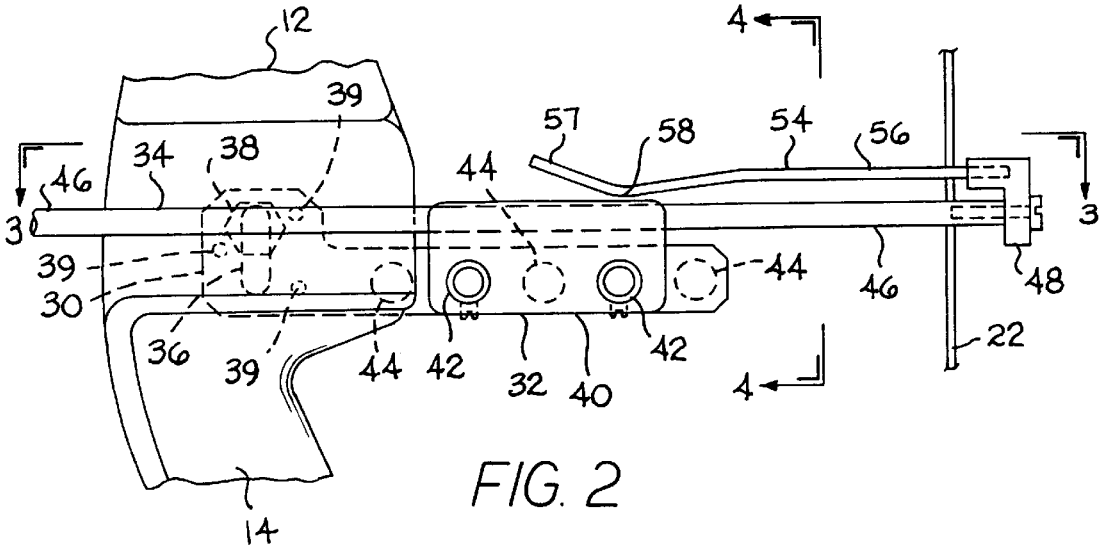
FIG. 2 is a fragmentary enlarged view taken in the same direction as FIG. 1, but showing constructional features not apparent in FIG. 1.

As shown in FIG. 2, mounting bar 30 has a vertical slot 36 therein adapted to receive the shank of a mounting bolt 38; the bolt threads into a pre-formed threaded hole in riser portion 12 to removably secure bar 30 on the archery bow. Three setscrews 39 thread into small threaded holes in bar 30 to exert clamp forces on riser portion 12, to prevent inadvertent rotational slippage of bar 30 around the bolt axis. Slot 36 permits vertical adjustments of bar 30 to meet individual preferences.

Linear guide mechanism 32 includes two separate guide blocks 40 supported on two horizontally spaced tubular supports 42 that extend right angularly from mounting bar 30 across the rear edge surface of riser 12. Each tubular support 42 has slip fit connections in pre-formed circular holes in bar 30 and two of the guide blocks 40. Setscrews 43 are used to lock tubular supports 42 to bar 30; similar setscrews are used to lock guide blocks 30 to the tubular supports 42.

Mounting bar 30 has a horizontal row of evenly spaced holes 44 adapted to selectively receive tubular supports 42. With bar 30 in a fixed position on riser 12, tubular supports 42 can be adjusted horizontally, by positioning the tubular supports in different ones of holes 44. The purpose of such horizontal adjustment is to provide clearance between the front most tubular support 42 and the rear edge of riser 12, while enabling the accessory to fit various archery bows having different riser cross-sectional dimensions.

Each guide block 40 is adjustable along tubular supports 42 in order to locate the guide blocks in proper alignment with bowstring 22, and also to vary the spacing between the guide blocks (for different diameter arrows).

Each guide block 40 has a circular bore near its upper edge that slidably accommodates an elongated hollow cylindrical arrow support member 46. The rear ends of arrow support members 46 extend into sockets in a small bridge member 48 located behind bowstring 22. The bridge member extends transversely across the bowstring, so that when the bowstring is manually pulled back from its illustrated position, the bridge member is propelled rearwardly with the bowstring; the bridge member draws arrow support members 46 through the guide blocks 40 in a rearward direction.

Figure 5:
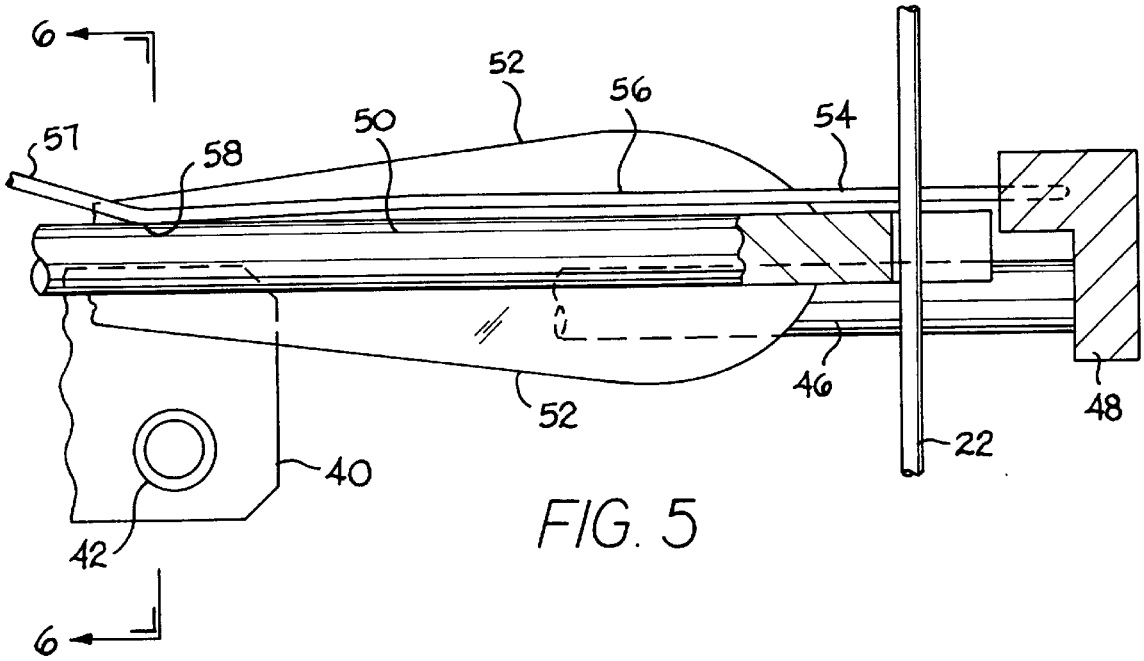
FIG. 5 is a fragmentary enlarged sectional view taken on line 5—5 in FIG. 4.
Figure 6:
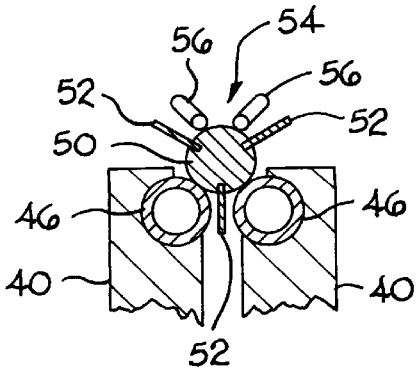
FIG. 6 is a transverse sectional view taken on line 6—6 in FIG. 5.

FIGS. 5 and 6 show the orientation of cylindrical arrow support member 46 relative to the arrow 50 and bowstring 22. The arrow has its undersurface resting on the two cylindrical support members 46, with one of the arrow vanes 52 extending downwardly in the space between the two cylindrical support members. Bowstring 22 extends downwardly through the arrow nock, with an appreciable clearance relative to the side surfaces or arrow support 46.

Arrows support members 46 have round cross sections in order to minimize bowstring wear, and to provide quiet arrow travel (minimal sound generation), while permitting a relatively easy draw back of the bowstring. Arrow support members 46 properly orient the arrow for reliable consistent travel along the desired flight path on release of the bowstring. When the bowstring is released, only the string and arrow move in the forward direction. Bridge 48 and arrow support members 46 remain in the "pulled back" positions, since bridge 48 is located behind the bowstring. Bridge 48 and arrow supports 46 constitute the aforementioned arrow support means 34.

As an important feature of the invention, the accessory includes an arrow retention means, designated generally by numeral 54. In the illustrated construction, the arrow retention means includes two laterally spaced resilient wands 56 extending forwardly from bridge 48 above arrow support members 46. Each wand 56 can be a small diameter brass rod (or stiff wire) having a circular cross section. Each rod can have a diameter of about 0.09 inch, and a length of about four and one half inches.

Figure 3:
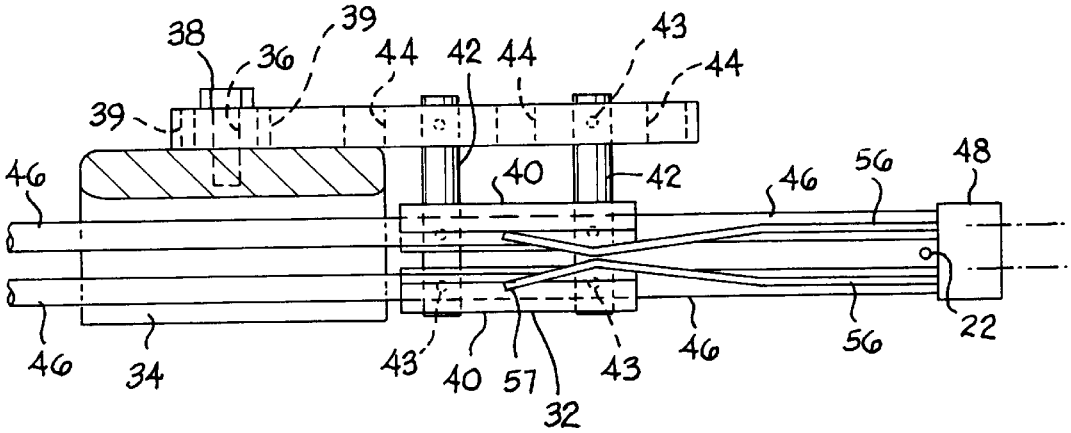
FIG. 3 is a sectional view taken on line 3—3 in FIG. 2.
Figure 4:
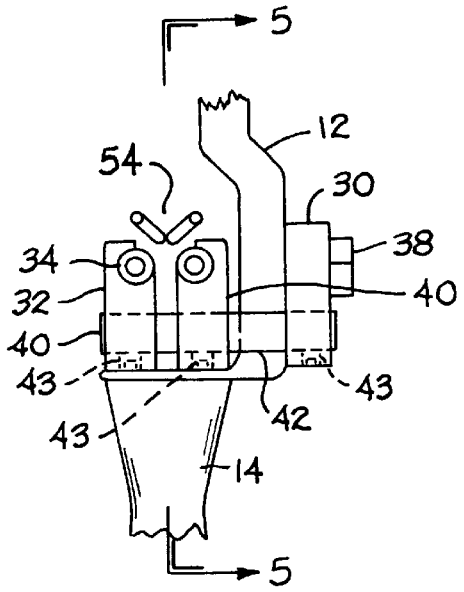
FIG. 4 is a transverse sectional view taken on line 4—4 in FIG. 2.

Each rod (wand) 56 has a cantilever mounting on bridge 48, such that the forward (free) end portion of the rod can resilient deflect from its normal position (FIGS. 2 and 3), when an arrow is slidably inserted onto arrow support members 46. The forward ends of rods 56 are upturned, as at 57, to facilitate manual insertion of an arrow onto the upper surface of support member 46.

Each resilient wand 56 has a section thereof that converges toward the arrow axis, such that the wand has a localized arrow contact zone 58 in pressure engagement with an arrow surface. The contact pressure is sufficient to prevent the arrow from disengaging from support members 46, but is not strong enough to impede the arrow during the arrow launch process.

As shown in FIG. 5, resilient wands 56 are spaced so that the two uppermost arrow vanes 52 are free and unobstructed. Wands 56 and arrow supports 46 are circumferentially arranged to define a central arrow accommodation space, whereby the arrow is securely positioned while still having relatively minimal frictional contact with the wands and support surfaces. The round cross sections of the wands and arrow support members provide essentially line contact on the arrow side surfaces. Wands 56 exert sufficient frictional pressure on the arrow, such that when the arrow is in the FIG. 5 position, the archery bow can be manipulated and moved without disturbing the arrow; the bow can be brought to a firing position without having to first fit an arrow to the bow.

To briefly summarize the operation of the bow accessory, an arrow 50 is brought to the FIG. 5 launch position by sliding the arrow rearwardly along the surfaces of arrow supports 46. Upturned ends 57 of wands 56 deflect upwardly a slight amount to produce a controlled frictional pressure between the arrow and contact zone 58 of each resilient wand; the nock on the arrow has a loose snap fit on the bowstring 22. To launch the arrow, the archer exerts a pull-back force on the bowstring, with his fingers or with a mechanical release aid. When the bowstring is pulled back, bridge 48 retracts the arrow supports 46 and arrow retention wands 56 along with the arrow. When the bowstring is released, the arrow is propelled forwardly, while arrow supports 46 and wands 56 remain in their retracted positions.

The arrow guidance-support accessory can be used with a range of different archery bows, without modifying or reconstructing the bow. Various adjustments are incorporated into the accessory to facilitate aiming and usage on a variety of differently dimensioned archery bows.

The guidance-support accessory will accommodate any size arrow with any standard broad head.

Having described my invention, I claim:

1. An accessory for an archery bow; comprising:

a linear guide means mountable on an archery bow above the arrow rest;

an arrow-support means slidable in said linear guide means for retracting motion in response to a manual pull on the bowstring; and frictional arrow retention means carried by said arrow support means.

2. The accessory of claim 1, wherein said arrow support means comprises a bridge adapted to span the space behind a bowstring, and two parallel elongated track elements extending from said bridge for slidable guidance in said linear guide means.

3. The accessory of claim 2, wherein said arrow retention means comprises two resilient wands extending from said bridge for frictional engagement with an arrow at points spaced forwardly from said bridge.

4. The accessory of claim 2, wherein each said track element comprises an elongated cylindrical arrow support member.

5. The accessory of claim 2, wherein each said track element comprises an elongated hollow cylindrical arrow support member.

6. The accessory of claim 2, wherein said arrow retention means comprises two resilient rods extending from said bridge, said rods having convergent sections spaced forwardly from said bridge for pressure engagement with an arrow supported on said track elements.

7. The accessory of claim 6, wherein each said track element comprises a hollow cylindrical arrow support member.

8. The accessory of claim 7, wherein said rods and said arrow support members are circumferentially arranged to define an arrow accommodation space.

9. The accessory of claim 1, and further comprising means for mounting said linear guide means on the riser portion of an archery bow.

10. The accessory of claim 9, wherein said mounting means comprises a mounting bar securable to the riser portion of an archery bow, and two parallel tubular supports extending right angularly from said mounting bar for disposition behind the archery bow; said linear guide means being carried on said tubular supports.

11. The accessory of claim 10, wherein said linear guide means comprises two separate guide blocks located at spaced points along said tubular supports; said arrow support means comprising two separate track elements individually slidable in the respective guide blocks.

12. The accessory of claim 11, wherein each guide block is adjustable on said tubular supports, whereby the guide block locations and guide block spacing can be varied.

13. The accessory of claim 10, wherein said mounting bar has a vertical slot therein for adjusting the bar up or down on the riser portion of an archery bow.

14. The accessory of claim 13, wherein said mounting bar has a horizontal row of holes for selectively receiving said tubular supports, whereby said tubular supports have clearance with respect to the riser portion of the bow.

* * * * *

UNITED STATES PATENT AND TRADEMARK OFFICE

CERTIFICATE OF CORRECTION

PATENT NO. : 6,079,399

DATED : June 27, 2000

INVENTOR(S) : Marc J. DeYonker

It is certified that error appears in the above-identified patent and that said Letters Patent is hereby corrected as shown below:

In the Title of the Invention, change "BOX" to -- BOW --.

Signed and Sealed this

First Day of May, 2001

Nicholas P. Godici

*Attest:*

NICHOLAS P. GODICI

*Attesting Officer*

*Acting Director of the United States Patent and Trademark Office*